US010046347B2

(12) United States Patent
Alluigi

(10) Patent No.: US 10,046,347 B2
(45) Date of Patent: Aug. 14, 2018

(54) TRIGGER DISPENSING DEVICE WITH AN UNREMOVABLE THREADED RING-NUT

(71) Applicant: GUALA DISPENSING S.p.A., Alessandria (IT)

(72) Inventor: Riccardo Alluigi, Alessandria (IT)

(73) Assignee: GUALA DISPENSING S.p.A., Alessandria (IT)

( * ) Notice: Subject to any disclaimer, the term of this patent is extended or adjusted under 35 U.S.C. 154(b) by 0 days.

(21) Appl. No.: 15/529,378

(22) PCT Filed: Oct. 30, 2015

(86) PCT No.: PCT/IB2015/058387
§ 371 (c)(1),
(2) Date: May 24, 2017

(87) PCT Pub. No.: WO2016/083921
PCT Pub. Date: Jun. 2, 2016

(65) Prior Publication Data

US 2017/0266677 A1 Sep. 21, 2017

(30) Foreign Application Priority Data

Nov. 27, 2014 (IT) ..... BS2014A0197

(51) Int. Cl.
*B67D 7/58* (2010.01)
*B67B 1/00* (2006.01)
(Continued)

(52) U.S. Cl.
CPC ..... *B05B 11/001* (2013.01); *B05B 11/0013* (2013.01); *B05B 11/3057* (2013.01); *B05B 11/3059* (2013.01)

(58) Field of Classification Search
CPC ..... B05B 11/001; B05B 11/0013; B05B 11/3057; B05B 11/3059
(Continued)

(56) References Cited

U.S. PATENT DOCUMENTS 5,169,033 A * 12/1992 Shay ..... B05B 11/3045 215/216
5,222,637 A * 6/1993 Giuffredi ..... B05B 11/3004 222/336
(Continued)

FOREIGN PATENT DOCUMENTS

CN 103608122 A 2/2014
EP 0 670 272 A1 9/1995
(Continued)

OTHER PUBLICATIONS

International Search Report and Written Opinion of the International Searching Authority for corresponding International Patent Application No. PCT/IB2015/058387 dated Feb. 29, 2016, 9 pgs.

*Primary Examiner* — Vishal Pancholi
(74) *Attorney, Agent, or Firm* — Merchant & Gould P.C.

(57) ABSTRACT

A head (4) of a trigger dispensing device for liquids includes an auxiliary body (30) for the connection with a neck (10) of a bottle (2). The auxiliary body (30) includes a closure base (32) suitable to close a mouth (13') of the bottle (2) and dual constraints suitable to snap-engage with the neck (10) forming between the auxiliary body (30) and the neck (10) a constraint both to the relative rotation and to the separation thereof.

11 Claims, 5 Drawing Sheets

(51) Int. Cl.
*B65D 88/54* (2006.01)
*B05B 11/00* (2006.01)

(58) Field of Classification Search
USPC ..... 222/153.09, 153.11, 321.7, 383.1, 548, 222/562
See application file for complete search history.

(56) References Cited

U.S. PATENT DOCUMENTS 5,360,127 A * 11/1994 Barriac ..... B05B 11/0008 215/263
5,873,496 A * 2/1999 Montaner ..... B05B 11/0016 222/153.09
6,032,814 A * 3/2000 Foster ..... B05B 11/001 215/332
6,138,873 A * 10/2000 Gramola ..... B05B 11/3045 222/153.14
8,317,063 B2 * 11/2012 Alluigi ..... B05B 11/303 222/153.09
8,887,967 B2 * 11/2014 Alluigi ..... B05B 11/3011 222/383.1
2002/0066802 A1 * 6/2002 Tada ..... B05B 7/0018 239/333
2011/0174843 A1 * 7/2011 Rech ..... B05B 11/0059 222/376
2012/0234871 A1 * 9/2012 Good ..... B05B 11/0016 222/382
2013/0161359 A1 * 6/2013 Alluigi ..... B05B 11/0016 222/383.1
2013/0221033 A1 * 8/2013 Alluigi ..... B05B 11/3011 222/383.1

FOREIGN PATENT DOCUMENTS

WO 97/46481 A1 12/1997
WO 2010/015304 A1 2/2010

* cited by examiner

TRIGGER DISPENSING DEVICE WITH AN UNREMOVABLE THREADED RING-NUT

This application is a National Stage Application of PCT/IB2015/058387, filed 30 Oct. 2015, which claims benefit of Serial No. BS2014A000197, filed 27 Nov. 2014 in Italy and which applications are incorporated herein by reference. To the extent appropriate, a claim of priority is made to each of the above disclosed applications.

BACKGROUND OF THE INVENTION

This invention relates to a trigger dispensing device for liquids, consisting of a bottle or container and a trigger dispensing head applied to the bottle.

In particular, this invention relates to a dispensing device in which the dispensing head is connected to the bottle by means of a threaded ring-nut.

Such devices have some drawbacks, for example during use of the device.

In particular, since the head is applied to the bottle, the two components are virtually integral with each other through the threaded ring-nut, all external actions accidentally acting on the dispensing head, for example due to shocks, vibrations during transport and handling by buyers in stores, produce a loosening of the ring-nut and thus the risk of the separation of the head from the bottle and the spillage of the liquid from the bottle.

SUMMARY OF THE INVENTION

The purpose of this invention is to overcome this drawback by providing a connection between the head and the bottle using a particularly reliable threaded ring-nut.

BRIEF DESCRIPTION OF THE DRAWINGS

The characteristics and advantages of the dispensing device according to this invention will be apparent from the following description, given by way of non-limiting example, in accordance with the accompanying figures, wherein.

DETAILED DESCRIPTION OF THE PREFERRED EMBODIMENTS

Figure 1:
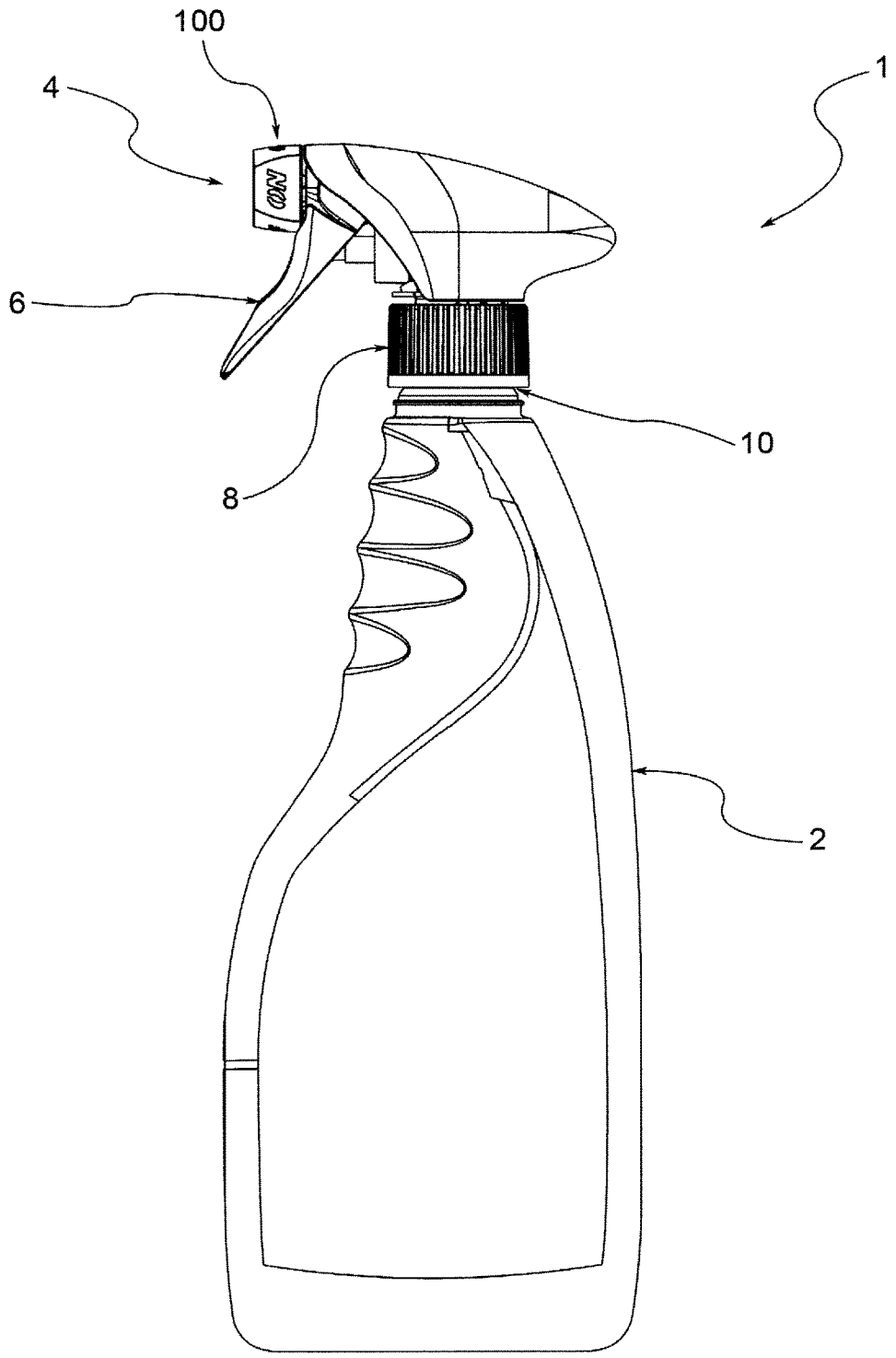
FIG. 1 shows a trigger dispensing device for liquids according to an embodiment of this invention.
Figure 2:
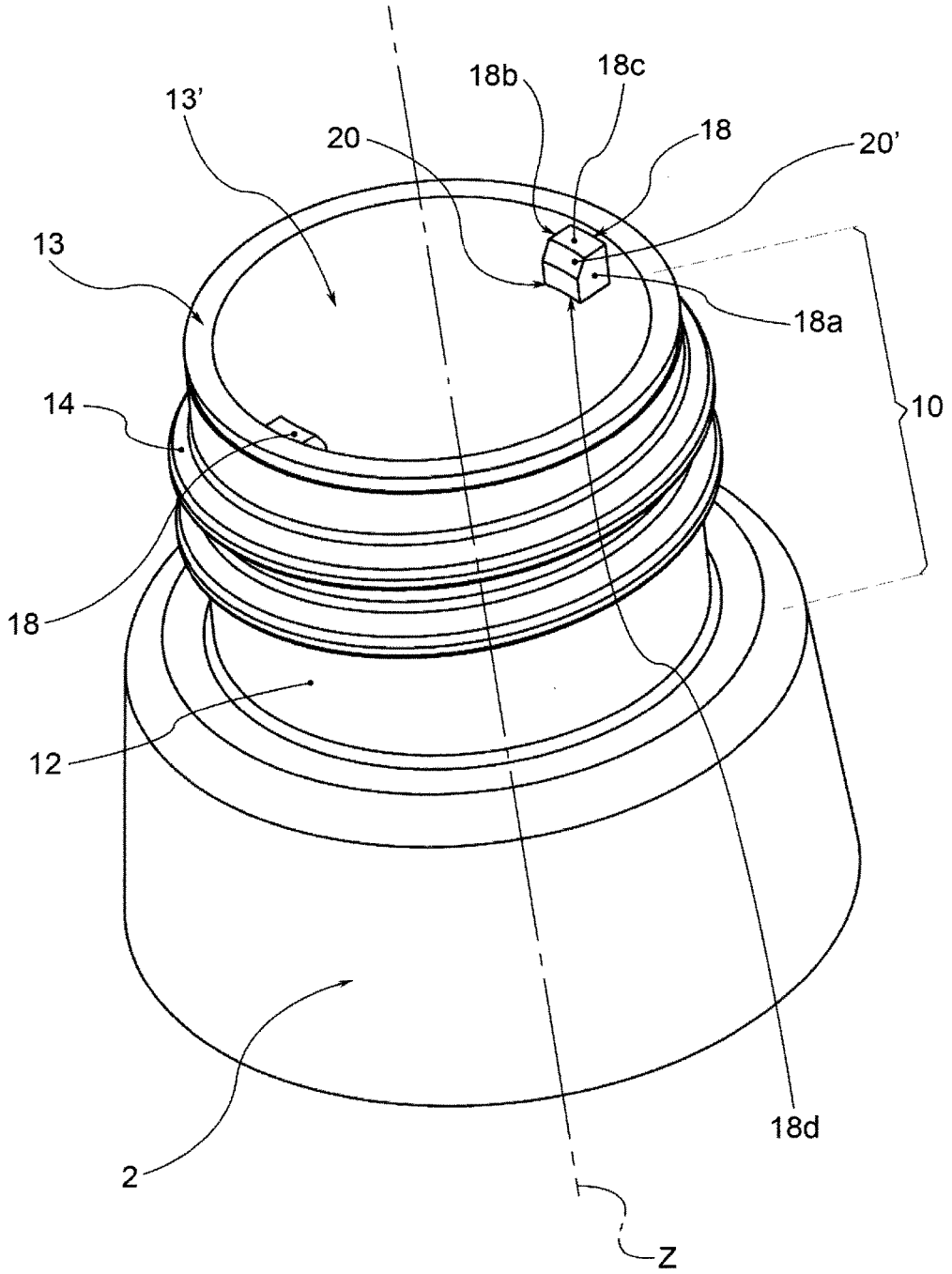
FIG. 2 shows a neck portion of a bottle of the device of FIG. 1.
Figure 3:
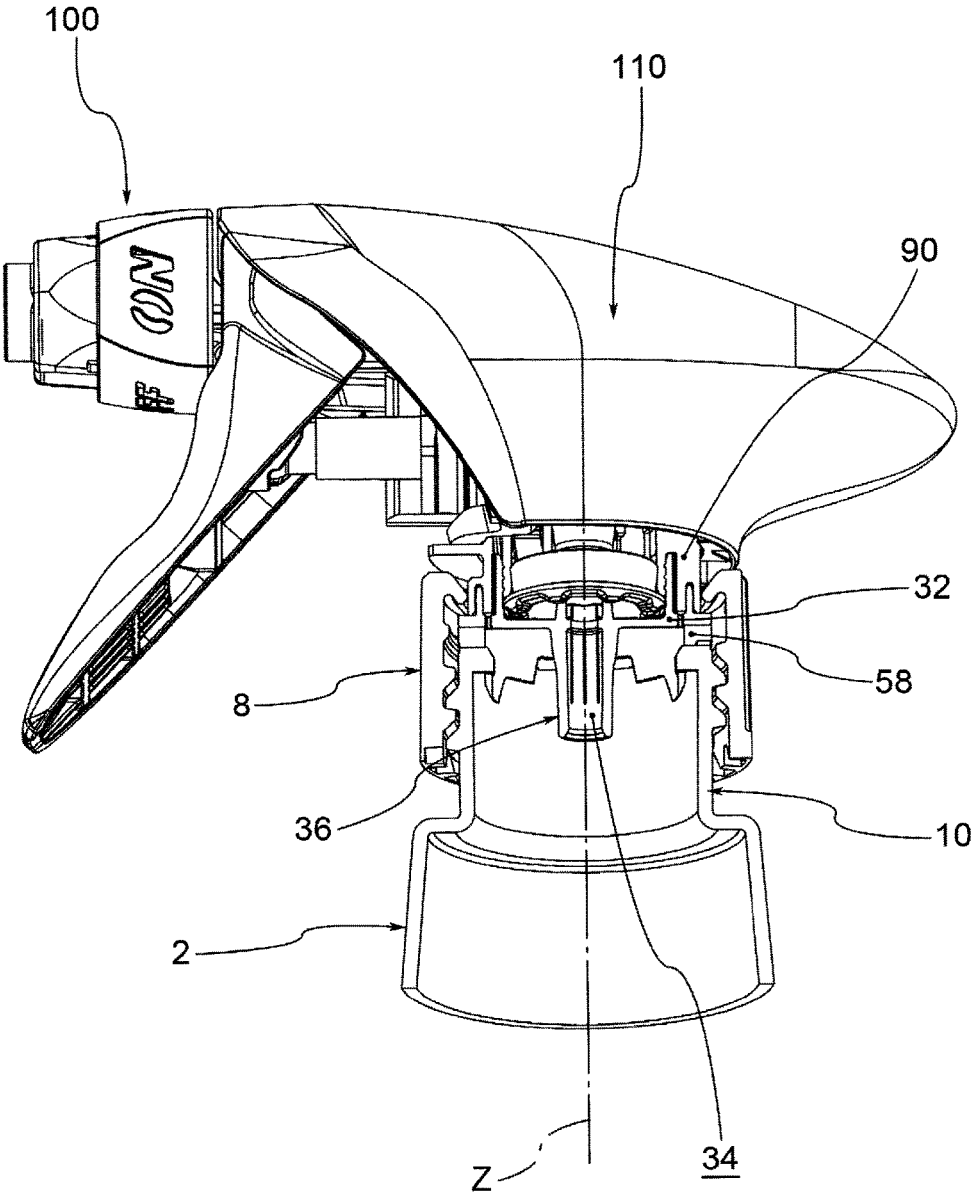
FIG. 3 shows a view partly in section of a dispensing head of the device of FIG. 1, applied to the neck of FIG. 2.
Figure 4:
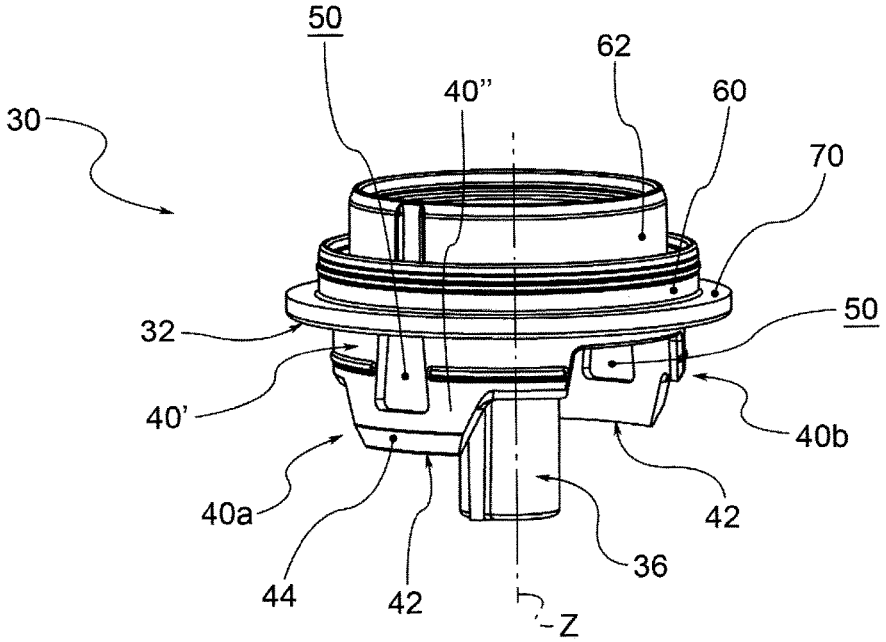
FIG. 4 shows an auxiliary body of the head of the FIG. 3 according to an embodiment.
Figure 5:
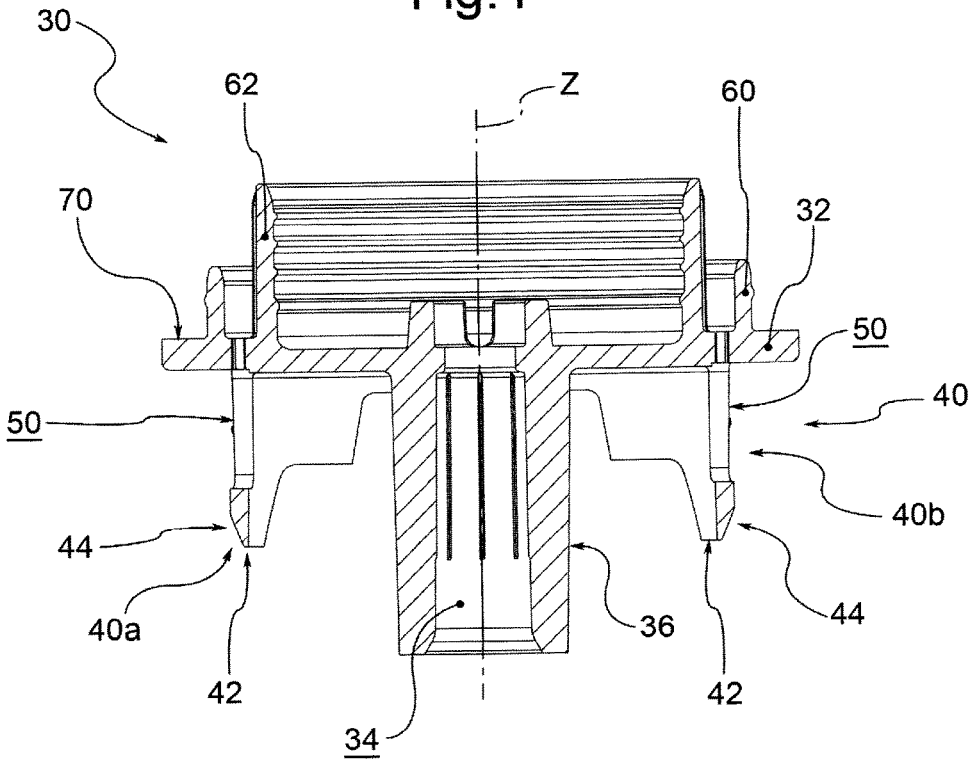
FIG. 5 shows a sectional view of the auxiliary body of FIG. 4.
Figure 6:
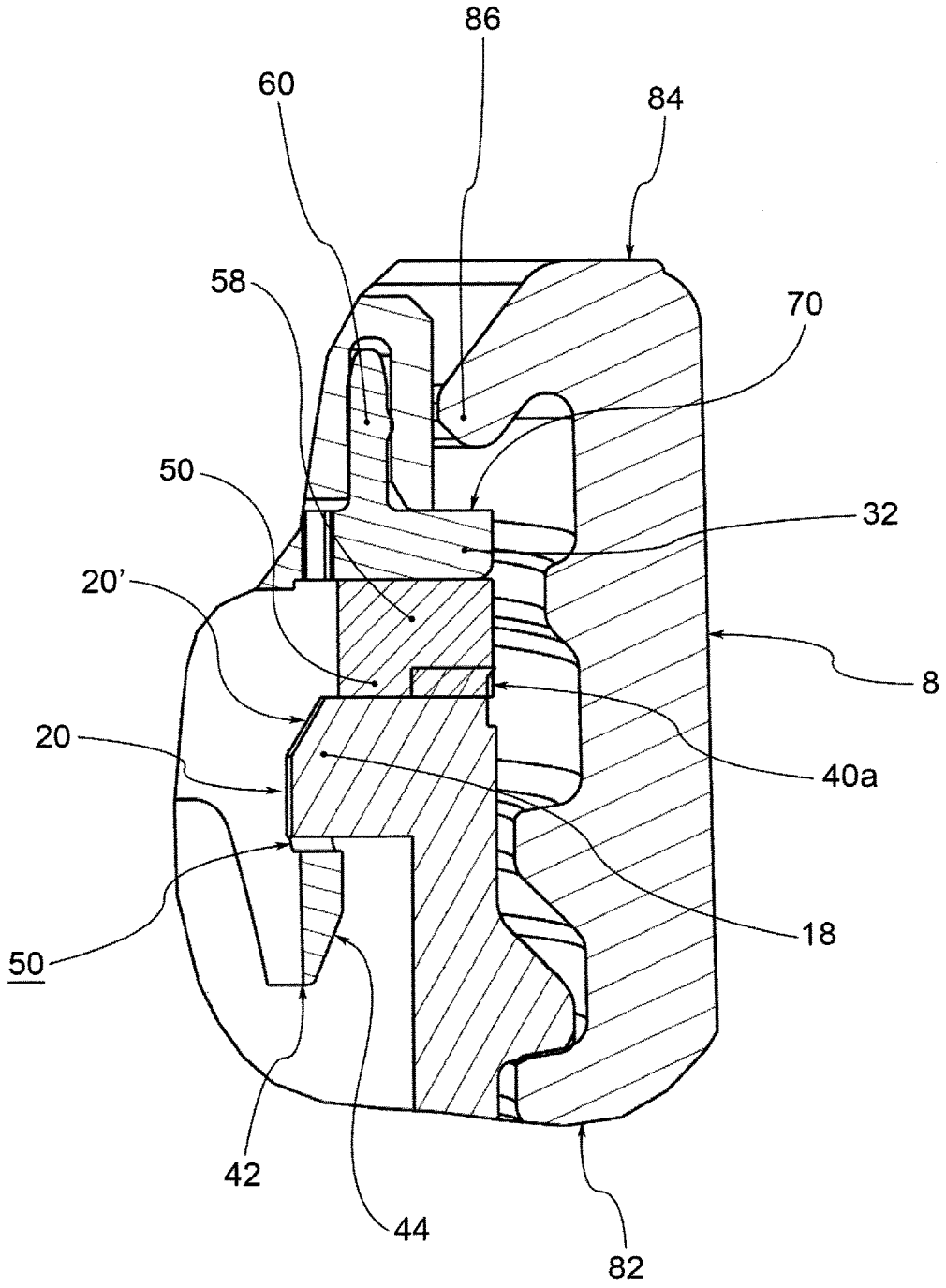
FIG. 6 shows an enlarged view of the region of engagement between the ring-nut, the auxiliary body and the neck.

With reference to the accompanying figures, reference number 1 globally identifies a trigger dispensing device for a liquid, generally used for containing and dispensing liquids for home hygiene, the treatment of the garments and the like.

The device 1 comprises a bottle or container 2 and a dispensing head 4, provided with a trigger 6 for dispensing the liquid and a ring-nut 8 for the threaded connection with a neck 10 of the bottle 2.

The neck 10 of the bottle 2 comprises an annular cylindrical neck wall 12 that defines a central neck axis Z, delimited by an annular crown surface 13 that delimits a mouth 13' for the bottle; on the outside, the neck wall 12 has a thread 14, continuous or interrupted, for the threaded connection with the ring-nut 8.

In addition, the neck 10 comprises at least one tooth projecting in a radial direction from the inner surface, of the neck wall 12.

For example, in the embodiment illustrated, the neck 10 comprises two teeth 18, for example radially opposed and substantially arranged on the same imaginary plane perpendicular to the neck axis Z.

Each tooth 18 is laterally delimited by a first side surface 18*a* and a second side surface 18*b*, spaced circumferentially; axially, instead, the tooth 18 is delimited by an upper axial surface 18*c* and a lower axial surface 18*d*, spaced axially; finally, frontally, the tooth 18 is delimited by a front surface 20, facing towards the neck axis 12, comprising an inclined surface 20' that creates a guide chamfer for the axial insertion of a component in the neck 10.

According to further embodiments (not shown), the neck comprises a single tooth, two (preferably arranged in opposing radial positions) or three (angularly evenly spaced).

The upper axial surface 18*c* of the teeth 18 is preferably disposed inside the neck 10, axially spaced from the crown surface. 13 of the neck wall 12.

According to an embodiment (not shown), the upper axial surface 18*c* is disposed in plane with said crown surface 13.

The dispensing head 2 comprises an auxiliary body 30, for example made in a single piece of plastic, for example by injection moulding.

The auxiliary body 30 comprises a closure base 32, for example disc-shaped, suitable to close the mouth of the neck 10, and provided with a suction duct 34 extending through its thickness, for example, coaxial with the neck axis Z. For example, the suction duct 34 is delimited by a suction tube 36, projecting axially from said closure base 32, intended to extend towards the inside of the bottle 2.

The auxiliary body 30 also comprises a coupling skirt 40, projecting axially from the closure base 32, on the same side of the suction tube 36. For example, the skirt 40 is arranged radially internally with respect to the peripheral edge of the closure base 32.

Preferably, the skirt 40 is composed of multiple portions spaced apart circumferentially. For example, in the embodiment illustrated, the skirt 40 comprises a first skirt portion 40*a* and a second skirt portion 40*b*, arranged symmetrically with respect to the neck axis Z.

According to a preferred embodiment, the skirt portion 40*a*,40*b* comprises an upper region 40', axially next to the closure base 32, and a lower region 40", axially adjacent to the upper region 40' and distal from the closure base 32. Preferably, the upper region 40' has a greater circumferential extension than the lower region 40", so as to limit the total amount of plastic material used for the auxiliary body 30.

Preferably, the lower region 40" ends axially with a free edge 42, in correspondence of which said lower region 40" has a chamfered guide surface 44 to facilitate the snap engagement with the teeth 18 of the neck 10 of the bottle 2.

Therefore, in a non-deformed configuration, the free edge 42 of the skirt portion 40*a*,40*b*, has a diameter greater than the minimum diameter of the front surface 20 of the tooth 18.

In addition, the skirt portion 40*a*, 40*b* comprises a window 50 passing through the thickness, suitable to receive a respective tooth 18 of the neck 10, creating an axial constraint that prevents the axial separation between the auxiliary body and the neck and a rotational constraint that prevents the relative rotation between the auxiliary body and the neck.

In other words, the circumferential dimension of the window 50 is such as to correspond to the circumferential dimension of the respective tooth of the neck, so that, creating the mutual engagement, there is no possibility of relative rotation between the auxiliary body and the neck.

Furthermore, preferably, the window 50 extends axially between the upper region 40' and the lower region 40".

Preferably, moreover, the auxiliary body 30 comprises a coupling ring 50, projecting axially from the closure base 32, on the side of the skirt 40. Said ring is disposed radially internally with respect to the peripheral edge of the closure base 32 and is suitable to rest against the teeth 18 of the neck 10, creating the support for the auxiliary body 30.

According to a further variant embodiment (not shown), the closure base rests directly on said teeth 18 of the neck 10.

According to a preferred embodiment, between the auxiliary body 30 and the neck 10, and in particular in contact with the crown surface 13, there is provided a sealing ring 58.

Furthermore, preferably, the auxiliary body 30 comprises at least one engagement collar projecting axially from the closure base 32, on the side opposite that of the skirt 40.

For example, the auxiliary body 30 comprises an outer collar 60, positioned radially inside the peripheral edge of the closure base 32 and an inner collar 62, positioned radially internally to the outer collar 60, having a second height. For example, the first height is less than the second height.

Between the outer collar 60 and the peripheral edge, the closure base 32 has a crown-shaped support surface 70 for the engagement with the ring-nut 8.

According to a preferred embodiment, the ring-nut 8, which extends axially from a free annular edge 82 to an annular edge of engagement 84, has an annular engagement lip 86 suitable to push the auxiliary body 30 against the neck 10 for screwing the ring-nut 8 on said neck 10.

For example, according to the embodiment illustrated, the engagement of lip 86 has a truncated cone shape, projecting radially internally from the engagement edge 84 of the ring-nut.

The dispensing head 4 also comprises a frame 90, preferably made as a separate component from the auxiliary body 3, for the support of the additional functional components necessary for the proper operation of the device, and in particular for the suction of the liquid through the suction duct 34, the pressurisation by means of a cylinder-piston system driven by the trigger, and the dispensing along a dispenser duct terminating with a nozzle 100, as well as for support of the cover 110.

Preferably, the frame 90 is engaged with the auxiliary body 30 via, said engagement collars 60,62, for example snap engagement.

For screwing the ring-nut 8 to the neck 10, the engagement lip 86 is first in contact with the auxiliary body 30, and in particular with the engagement surface 70 of the closure base 32, and, by persevering in the screwing, pushes the auxiliary body 30 against the crown surface 13 of the neck 10.

At the same time, the insertion of the skirt 40 of the auxiliary body 30 in the neck 10 causes the engagement, in particular snap engagement, between the teeth 18 of the neck 10 and said skirt 40; in particular, the teeth 18 snap into the windows 50 of the skirt 40, preventing both the rotation of auxiliary body 30 with respect to the neck 10 and axial separation.

Any accidental action on the head of the device, for example due to a purchaser or to a user, does not create a relative rotation between the auxiliary body and the neck, since the engagement of the teeth with the skirt blocks such relative rotations. Consequently, the screwing of the ring-nut to the neck is reliable, since such external actions do not contribute to the unscrewing, of the ring-nut.

If, despite everything, the ring-nut was unscrewed from the neck, the spillage of the liquid is inhibited, since the closure base of the auxiliary body is locked to the neck, because snap engaged with the teeth, which prevent axial disengagement.

In other words, the engagement between the skit 40 of the auxiliary body 30 and the teeth 18 received in the respective window 50 create an example embodiment of dual constraint means suitable to snap-engage with the neck 10 forming between the auxiliary body 30 and the neck 10 a constraint both to the relative rotation and to the separation thereof.

Innovatively, the dispensing device according to this invention overcomes' the drawbacks of the known art, since it allows creating a connection with threaded ring-nut between the dispensing head and bottle having a high reliability.

In particular, the device according to this invention, by using the same engagement between teeth and windows of the auxiliary body, prevents both accidental unscrewing of the ring-nut as a result of actions operating on the dispensing head (or bottle) and spilling the contents of the bottle when the ring-nut, despite everything, is unscrewed.

Advantageously, moreover, the device is particularly safe in the event of handling by children, since access to the liquid contained in the bottle is prevented, even if the ring-nut was unscrewed voluntarily.

According to a further advantageous aspect, this invention allows realising a device with ring-nut that is not removable without modifying the conventional geometry of the ring specified by the SPI legislation (for example with codes SPI 28/410 and SPI 28/400, which define diameter and height). On the contrary, according to the prior art (see, for example, document EP-A1-0670272), to obtain devices with unremovable ring-nut, the ring-nut and the bottle are modified according to need, creating difficulty in designing and fine-tuning the device.

Usually, the bottle and dispensing head are produced separately in respective manufacturing plants (sometimes different for the head and the bottle), and then sent to a plant for filling and application, in which the bottle is filled with the liquid and the head is applied to the filled bottle, by screwing of the threaded ring-nut to the neck of the bottle.

The operation of screwing the ring-nut to the neck is very delicate and, for the devices of the prior art, generally takes place at low speed, to avoid frequent jamming of the screwing machine, due to the relative rotation between the head and neck.

Take into account that the current world production of such devices is of some hundreds of millions of pieces per year, for which machine downtime can compromise the economic character of production.

Instead, advantageously, the device according to this invention allows screwing the ring nut to the neck, during the application of the head to the bottle, with high screwing machine speeds, since the relative rotation between the neck and head is prevented.

It is clear that one skilled in the art, in order to meet contingent needs, may make changes to the dispensing device described above, all contained within the scope of protection defined by the following claims.

The invention claimed is:

1. Trigger dispensing head for liquids, comprising:

an auxiliary body for connection to a neck of a bottle, suitable to support further functional components of the dispensing head; and a threaded ring-nut suitable to be screwed to the neck of the bottle and to operate on the auxiliary body to connect the auxiliary body to the neck;

wherein the auxiliary body comprises a closure base suitable to close a mouth of the bottle and a dual constraint suitable to snap-engage with the neck forming between the auxiliary body and the neck a constraint both to relative rotation and to axial separation between the auxiliary body and the neck;

wherein said dual constraint comprises a coupling skirt to the auxiliary body, said skirt protruding from the closure base and comprising at least one skirt portion provided with at least one window suitable to snap-house a respective tooth of the neck.

2. Dispensing head according to claim 1, wherein said skirt portion axially ends with a free edge which has a guide surface chamfered to facilitate the snap engagement with the teeth of the neck.

3. Dispensing head according to claim 1, wherein several portions of skirt are provided for, each having a partial circumferential extension and comprising an upper region next to the closure base, and a lower region axially adjacent to the upper region and distal from the closure base, wherein the upper region has a greater circumferential extension than the lower region.

4. Dispensing head according to claim 3, wherein the window extends between the upper region and the lower region.

5. Dispensing head according to claim 1, comprising a frame for supporting auxiliary components, and wherein the auxiliary body comprises at least one engagement collar projecting from the closure base, suitable to engage with said frame.

6. Dispensing head according to claim 5, wherein the auxiliary body comprises an outer collar positioned radially inside the peripheral edge of the closure base and an inner collar positioned radially internally to the outer collar.

7. Dispensing head according to claim 6, wherein between the outer collar and the peripheral edge, the closure base has a crown-shaped support surface for the engagement with the ring-nut.

8. Dispensing head according to claim 1, wherein the auxiliary body comprises a coupling ring projecting from the closure base positioned radially internally with respect to the peripheral edge of the closure base suitable to rest on the teeth of the neck, forming the support for the auxiliary body.

9. Dispensing head according to claim 1, wherein the ring-nut, which extends axially from a free annular edge to an annular edge of engagement, has an annular engagement lip of a truncated-conical shape, projecting radially internally from the engagement edge of the ring-nut and suitable to operate on the auxiliary body to connect the auxiliary body to the neck.

10. Trigger dispensing device comprising a bottle and a dispensing head, the dispensing head comprising:

an auxiliary body for connection to a neck of a bottle, suitable to support further functional components of the dispensing head; and a threaded ring-nut suitable to be screwed to the neck of the bottle and to operate on the auxiliary body to connect the auxiliary body to the neck;

wherein the auxiliary body comprises a closure base suitable to close a mouth of the bottle and a dual constraint suitable to snap-engage with the neck forming between the auxiliary body and the neck a constraint both to the relative rotation and to the axial separation thereof; and wherein the dispensing head is applied to the bottle by the threaded ring-nut;

wherein said dual constraint comprises a coupling skirt to the auxiliary body, said skirt protruding from the closure base and comprising at least one skirt portion provided with at least one window suitable to snap-house a respective tooth of the neck.

11. Device according to claim 10, wherein between the auxiliary body and a crown surface of the neck of the bottle a sealing ring in compression is placed.

* * * * *